US005143248A

United States Patent [19]

Sawatsky

[11] Patent Number: 5,143,248

[45] Date of Patent: Sep. 1, 1992

[54] RECLOSEABLE COFFEE CUP COVER

[76] Inventor: David P. Sawatsky, 12 Ballycastle Crescent, Brampton, Ontario, Canada L6Z 2V5

[21] Appl. No.: 537,842

[22] Filed: Jun. 13, 1990

[51] Int. Cl.[5] ..... B65D 47/20; B65D 51/18

[52] U.S. Cl. ..... 220/711; 220/254; 220/307; 220/253; 220/713; 220/714; 220/715; 220/343

[58] Field of Search ..... 220/90.2, 90.4, 90.6, 220/254, 259, 287, 338, 343, 356, 253; 215/DIG. 1

[56] References Cited

U.S. PATENT DOCUMENTS

| | | | |
|---|---|---|---|
| 2,437,784 | 3/1948 | Laskin | 220/90.4 |
| 3,208,629 | 9/1965 | Beeson | 220/90.4 |
| 3,360,161 | 12/1967 | Smith | 220/90.4 |
| 3,486,665 | 12/1969 | LaCroce | 220/254 X |
| 3,595,421 | 7/1971 | Sanchis | 215/DIG. 1 X |
| 3,720,346 | 3/1973 | Cypher | 220/254 X |
| 3,727,808 | 4/1973 | Fitzgerald | 220/90.4 X |
| 3,730,399 | 5/1973 | Dibrell et al. | 220/90.4 X |
| 3,854,617 | 12/1974 | Edwards | 215/364 |
| 3,860,162 | 1/1975 | Schutz | 220/90.4 X |
| 3,874,580 | 4/1975 | Weatherhead | 220/253 X |
| 4,138,033 | 2/1979 | Payne et al. | 220/254 |
| 4,183,443 | 1/1980 | DeParales et al. | 220/90.4 |
| 4,184,603 | 1/1980 | Hamilton, Sr. | 220/254 |
| 4,184,604 | 1/1980 | Amberg et al. | 220/90.4 X |
| 4,190,174 | 2/1980 | Haimowitz | 220/254 |
| 4,331,255 | 5/1982 | Fournier | 220/90.4 X |
| 4,350,260 | 9/1982 | Prueher | 220/254 |
| 4,361,249 | 11/1982 | Tuneski et al. | 220/254 |
| 4,380,304 | 4/1983 | Anderson | 220/306 |
| 4,579,245 | 4/1986 | Narushko | 220/254 X |
| 4,611,725 | 9/1986 | Kacalieff | 220/253 |
| 4,790,444 | 12/1988 | Terzi | 220/90.2 |
| 4,792,054 | 12/1988 | Weidman | 220/253 X |
| 4,949,865 | 8/1990 | Turner | 220/90.2 X |
| 4,986,437 | 1/1991 | Farmer | 220/90.2 |

*Primary Examiner*—Stephen P. Garbe
*Assistant Examiner*—Vanessa Caretto

[57] ABSTRACT

A removable closure cover for a drinking vessel such as a cup or mug has an outer cover for attachment to the mouth of the vessel, with an aperture adjacent the edge through which a user may drink. An inner cover secured to the outer cover is selectively moveable into opening or closing relation with the aperture. While useable with insulated plastic drinking cups, the closure cover also may be used with traditional mug or cup forms, to enable transportation of a hot drink in sealed, insulated relation, thus extending the utility of the traditional, non-disposable mug, in an ecology promoting fashion. Manipulation of the cover provides controlled ventilation of the container and permits modulation of the cooling time for a hot drink contained therein.

8 Claims, 4 Drawing Sheets

RECLOSEABLE COFFEE CUP COVER

TECHNICAL FIELD

This invention is directed to a removable closure cover, and in particular to a closure cover having a reclosable aperture for use with a drinking vessel, to permit use and reclosure of the vessel.

BACKGROUND ART

Drinking vessels such as cups and mugs come in a wide variety of types, including china mugs with replaceable lids, traditional drinking mugs of various shapes, sizes and materials, including beer steins With hinged lids, and disposable paper and plastic cups.

In the case of china mugs with lids, the lid serves to stabilize the temperature of the contents, and to prevent spillage and the entry of foreign or contaminating matter, and is removed when one wishes to drink, making the lid susceptible to loss and breakage.

The use of traditional drinking mugs has been superceded in significant measure by disposable cups of papers and styrofoam, which frequently include tops having tear tabs to provides drinking access. The widespread use of such disposables forms a part of our present ecological problems.

In addition to the many varieties of removable, disposable covers having a skirt portion which grip the outside of the cup rim, there are plastic covers with tear-off segments that form a drinking aperture, and various other receptacle variants, as illustrated in the following listed Canadian patents:

945,940, April 1974, Rathbun;

1,012,928, June 1977, Albert et al.;

1,056,332, June 1979, Douglas; and 1,139,716, January 1983, Philip

In the case of beer stein containers With hinged lids, these are cumbersome and awkward to use, and little suited to use with ordinary beverages such as cold and hot drinks.

DISCLOSURE OF INVENTION

The present invention provides a removable closure cover for use with a drinking vessel such as a cup or mug, the cover having a fixed first portion for firm attachment to the mouth of the vessel, with an aperture therethrough adjacent an edge portion thereof for the passage of fluid therethrough; a second cover portion secured to the first cover portion, and selectively rotatably movable in parallel relation relative thereto in opening and closing relation with the aperture.

The subject cover is of use in cooperation with traditional type vessels, including plastic cups and mugs such as those injection molded in styrene, acrylic or styrene acrillo nitrile (SAN), for instance, as well as with disposable cups, which may be vacuum formed.

Use with ceramic mugs also is contemplated.

In one embodiment of the invention the fixed first portion of the cover has a rim portion thereof that, in use is secured in adjoining relation with a rim of the mug or other vessel, having the second portion of the cover secured therebeneath, to lie within the mug. In one embodiment the second portion of the cover is preferably pivotally secured to the first portion, generally at the common geometrical centres thereof and substantially parallel therewith, for pivotal rotational displacement in opening and closing relation with the aperture.

The cover first portion may be canted, relative to the cover rim portion, to provide in use an upper surface thereof inclined towards the aperture, to facilitate drainage of liquid towards the aperture, when the contents splash thereon.

In one preferred embodiment, a mechanism for opening and closing the cover comprises an upstanding tab connecting with the cover second portion, which facilitates the opening and closing of the aperture.

One cover embodiment has the tab extending through the drinking aperture, for displacement thereacross.

A further cover embodiment the opening and closing arrangement has the tab extending through a slot in the cover first portion.

In the case of the cover embodiment having the second cover pivotally secured to the first cover portion the slot through which the opening and closing tab projects extends arcuately in the cover first portion.

The provision of an air bleed orifice located opposite to the drinking aperture, which orifice is open when the aperture is open, facilitates the smooth passage of beverage to the user. The inner cover portion is generally arranged to seal off the bleed orifice when the cover is closed.

In a further embodiment the inner cover portion may be located in axially spaced relation from the first cover portion, having a skirt portion to define an enclosed air space in thermal insulating relation with the receptacle or vessel.

The movable cover portion may be made separable from the outer cover portion so as to permit disassembly thereof for cleaning purposes, to maintain hygiene and foster an extended service life.

The axial air space between the first and second portions of the cover may be substantially enclosed by a projecting, skirt portion, to limit the transfer of vapor and heated air.

In one embodiment the insulating skirt portion may be secured to the cover second portion, in upstanding, substantial sealing relation with the underside of the first, fixed cover portion. A preferred embodiment includes an upwardly offset closure portion of the second cover portion, to effect sealing contact with the underside of the cover first portion, and in a closed position, to seal off the access aperture through the cover.

One embodiment may incorporate auxiliary skirt seals extending outwardly for at least a portion of the periphery of the skirt, to provide a sealing fit with a wider range of mug sizes, wherein the softly flexible auxiliary seals compensate for moderate variations in mug diameters.

BRIEF DESCRIPTION OF DRAWINGS

Certain embodiments of the invention are described by way of example, without limitation of the invention thereto, reference being made to the accompanying drawings, wherein.

BEST MODE OF CARRYING OUT THE INVENTION

Figure 1:
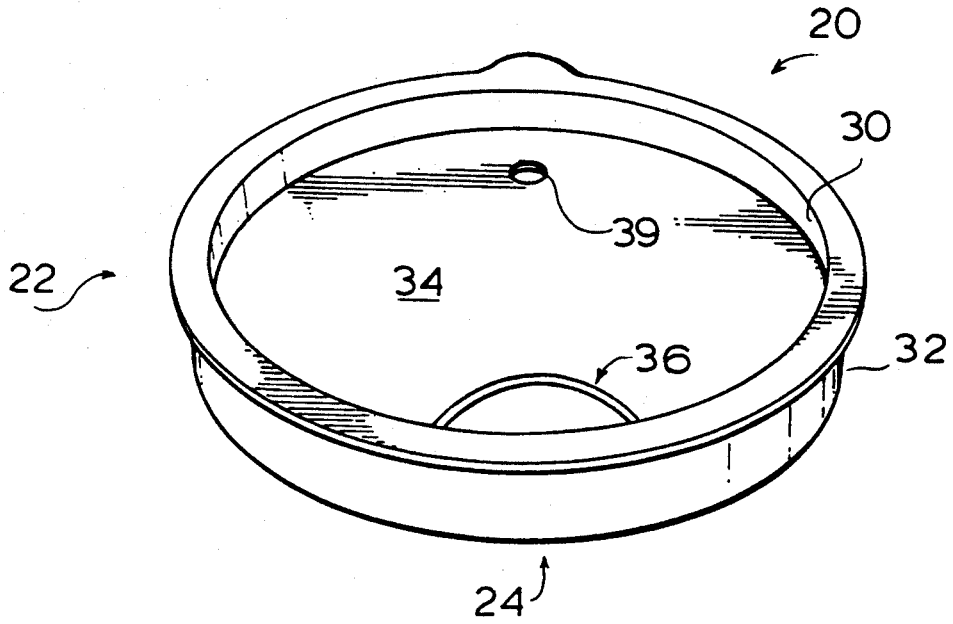
FIG. 1 is a general view of a first cover embodiment in accordance with the present invention, in a closed condition.
Figure 2:
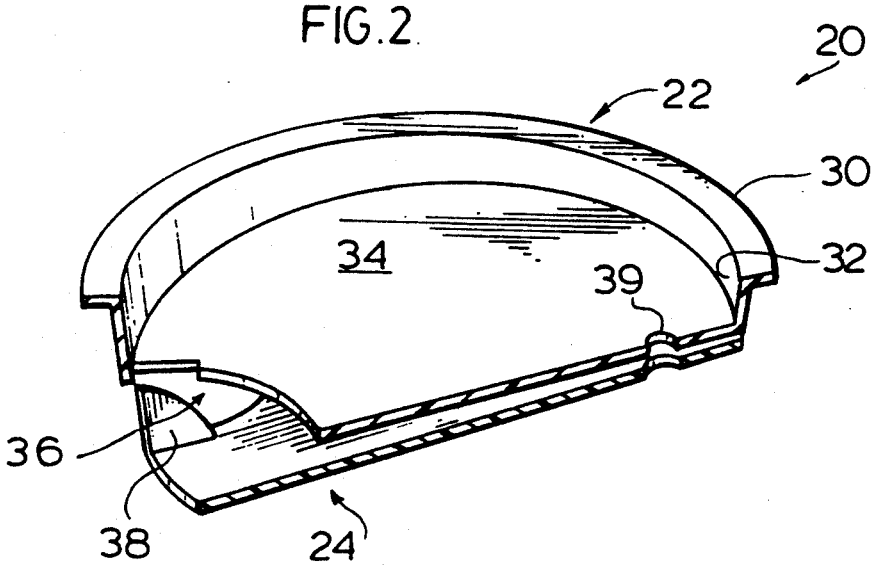
FIG. 2 is a general view in diammetrical section of the FIG. 1 embodiment, in a partially opened condition.
Figure 3:
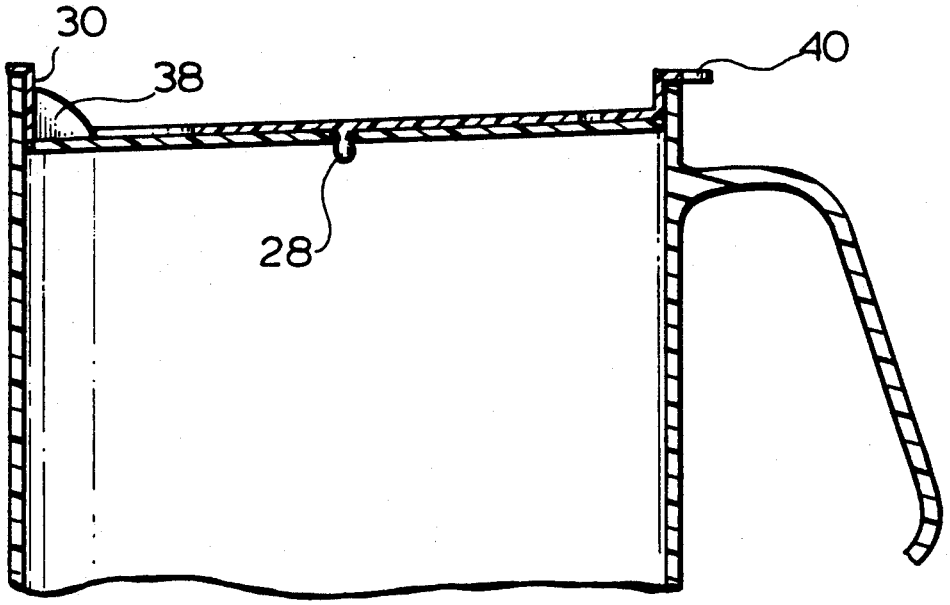
FIG. 3 is a diammetrical section, in elevation, of the FIG. 1 and 2 embodiment insert in a mug (also sectioned)
Figure 4:
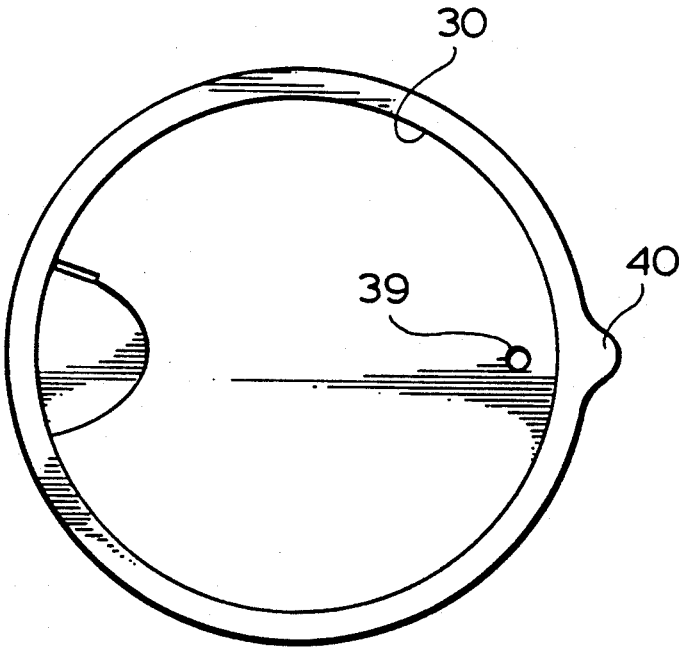
FIG. 4 is a plan view of the FIG. 3 arrangement.

Referring to FIGS. 1 and 2, a first embodiment cover 20 has a cover upper portion 22 and a lower portion 24 pivotally secured thereto at 28 by way of a downwardly extending pintle 28. The upper portion 22 has a rim 30 and peripheral skirt portion 32 supporting cover portion 34 through which a drinking aperture 36 extends.

The skirt portion 32 is tapered, thereby inclining the cover portion 34 in sloping relation towards the aperture 36.

A tab 38 extending upwardly from lower cover portion 24 facilitates closing and opening of the aperture 36. An air bleed orifice 39 fosters the smooth flow of liquid through the aperture 36. A projecting lip portion 40 provides easy removal of the cover 20, without impeding access of a user in taking a drink from the mug 42.

Figure 5:
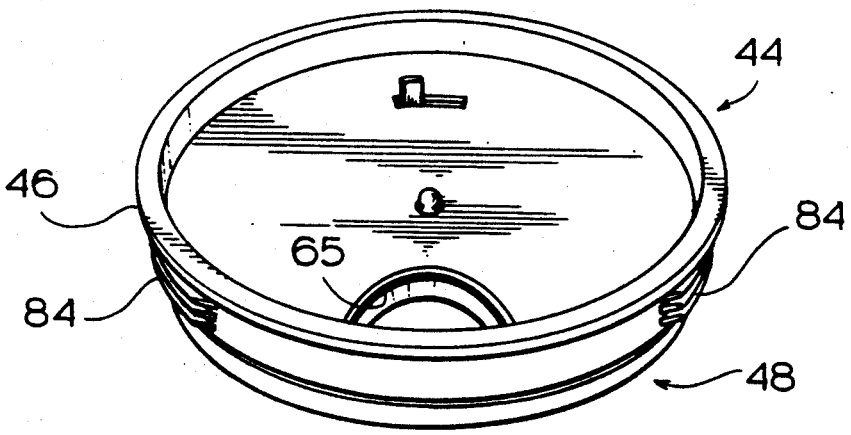
FIG. 5 is a general view corresponding to FIG. 1 of a further embodiment.
Figure 6:
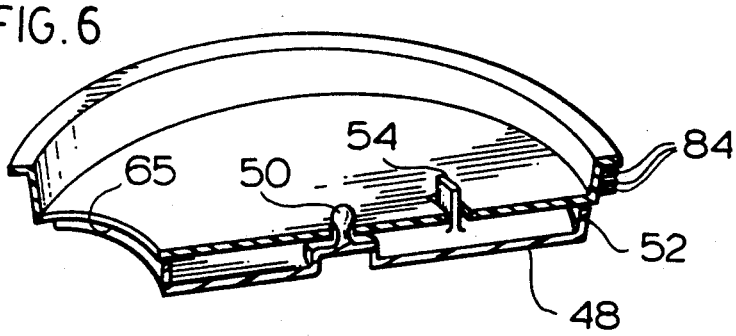
FIG. 6 is a view corresponding to FIG. 2, of the FIG. 5 embodiment.
Figure 7:
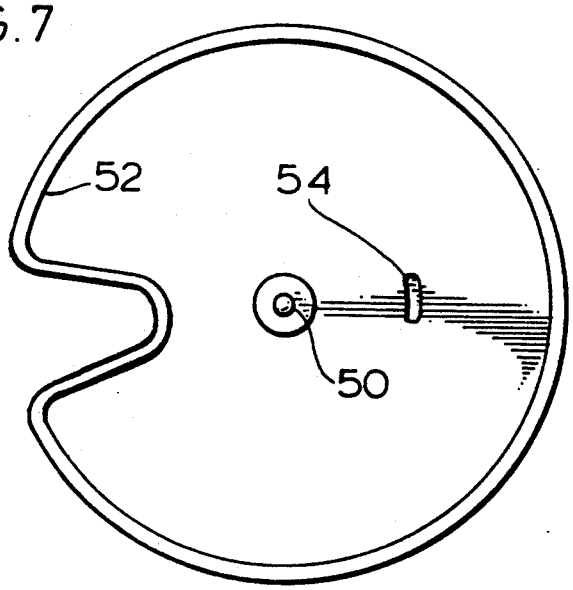
FIG. 7 is a plan view of the closure member of the FIG. 5 and 6 embodiment.

Referring to FIGS. 5, 6 and 7, the cover 44 has an upper portion 46 and a lower portion 48.

An upwardly extending pintle 50 is secured to cover portion 48, which also has peripheral skirt portion 52 and operating tab 54 extending upwardly therefrom. The upwardly extending skirt portion 52 defines a substantially enclosed insulating air space 55 between upper cover portion 46 and lower cover portion 48.

Figure 8:
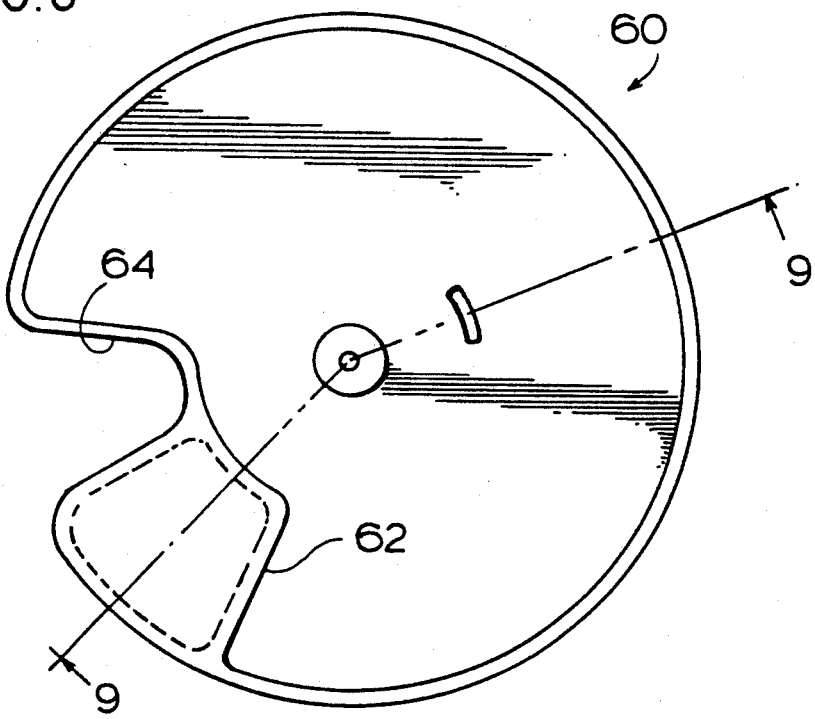
FIG. 8 is a view corresponding to FIG. 7 of a further closure member embodiment, suitable for use with the cover of FIGS. 5 and 6.
Figure 9:
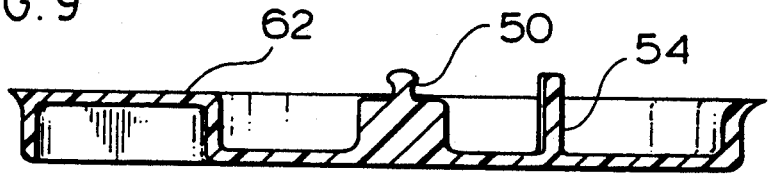
FIG. 9 is a section taken at 9—9 of FIG. 8.

Referring to the lower cover embodiment 60, in FIG. 8 and 9, a raised platform potion 62, adjacent flow recess 64 provides flush sealing beneath the rim 65 of the FIG. 5 upper cover portion 46.

Flexible auxiliary skirt seals 84 extending about at least a portion of the periphery of the skirt portion of cover 20 or 44 extend the range of variation in mug diameter to which the covers 20, 44 may be sealingly attached. The auxiliary seals 84 may be provided about the full periphery of covers 20 or 44.

It will be understood that the canted upper cover portion illustrated in the FIG. 1 embodiment may be incorporated in the alternative embodiments.

The covers may be of a light duty, disposable nature, or they may be more durably made, for more permanent use.

The respective pintles 28, 50 may be sized, relative to the respective aperture of the opposed cover portion to provide a snap fit therewith, relying upon the plastic nature of the opposed cover portion containing the aperture to secure and substantially seal the respective pintle to its aperture.

INDUSTRIAL APPLICABILITY

The subject cover may be used, in conjunction with disposable or more permanent vessels. In addition to use with cups and mugs, they also may be used with jugs, primarily for dispensing beverage liquids.

I claim:

1. A removable closure cover for use with a drinking vessel such as a cup or mug, said cover having a fixed first portion for attachment to the mouth of the vessel, with an aperture therethrough adjacent an edge portion thereof for the passage of fluid therethrough; pintle means located beneath said cover first portion; a second cover portion rotatably secured by said pintle means beneath the first cover portion and selectively rotatably movable relative thereto in opening and closing relation with the aperture.

2. A removable closure cover for use with a drinking vessel such as a cup or mug, said cover having a fixed first portion for attachment to the mouth of the vessel, with an aperture therethrough adjacent an edge portion thereof for the passage of fluid therethrough; pintle means located beneath said cover first portion; a second cover portion rotatably secured by said pintle means beneath the first cover portion and selectively rotatably movable relative thereto in opening and closing relation with the aperture; and an air bleed orifice extending through said fixed first cover portion.

3. The cover as set fourth in claim 2 said cover second portion having an air bleed orifice positioned in effective communication relation with said first cover portion bleed orifice when said aperture is in an open condition.

4. A removable closure cover for use with a drinking vessel such as a cup or mug, said cover having a fixed first substantially planar portion for attachment in closing relation to the mouth of the vessel, with an aperture therethrough adjacent an edge portion thereof for the passage of liquid therethrough; a second substantially planar cover portion lying below and rotatably and pivotally secured to the first cover portion and selectively movable in substantially parallel rotational relation relative thereto in opening and closing relation with the aperture.

5. The cover as set forth in claim 4, said second cover portion, in use, lying below said first cover portion.

6. The cover as set forth in claim 5, said first cover portion having downwardly depending pintle means therebeneath, having said second cover portion pivotally secured thereon.

7. The cover as set forth in claim 6, said second cover portion having upwardly extending pintle means in pivotal, substantially sealed relation with an aperture in said first cover portion.

8. The cover as set forth in claim 5, said cover first portion having an air bleed orifice therethrough.

* * * * *